US010180225B2

(12) United States Patent
Noronha et al.

(10) Patent No.: US 10,180,225 B2
(45) Date of Patent: Jan. 15, 2019

(54) CUTOFF MECHANISM COMPRISING A BAR CARRYING A PERMANENT MAGNET

(71) Applicant: AML SYSTEMS, Paris (FR)

(72) Inventors: Anderson Noronha, Fontenay sous bois (FR); Daniel Lopez, Gagny (FR); Hassan Koulouh, Le Pré Saint Gervais (FR)

(73) Assignee: AML Systems, Paris (FR)

( * ) Notice: Subject to any disclaimer, the term of this patent is extended or adjusted under 35 U.S.C. 154(b) by 594 days.

(21) Appl. No.: 14/795,752

(22) Filed: Jul. 9, 2015

(65) Prior Publication Data

US 2016/0010824 A1 Jan. 14, 2016

(30) Foreign Application Priority Data

Jul. 9, 2014 (FR) ..... 14 56610

(51) Int. Cl.
*F21V 17/02* (2006.01)
*F21S 41/686* (2018.01)

(52) U.S. Cl.
CPC ..... *F21S 41/686* (2018.01)

(58) Field of Classification Search
CPC ..... B60Q 1/1438; H02K 33/02; F21S 41/68–41/698
USPC ..... 362/512–513
See application file for complete search history.

(56) References Cited

U.S. PATENT DOCUMENTS

2010/0103690 A1* 4/2010 Keilig ..... F21S 41/686 362/513
2010/0142216 A1 6/2010 Huang
2012/0306295 A1* 12/2012 Kirstein ..... H01F 7/1615 310/15
2013/0236337 A1* 9/2013 Gummin ..... F04B 43/043 417/412

FOREIGN PATENT DOCUMENTS

CN 102848969 A 1/2013
DE 20 2012 003 108 U1 1/2013
EP 1 455 133 A1 9/2004
EP 2 442 017 A1 4/2012

OTHER PUBLICATIONS

Search Report dated Mar. 23, 2015, issued in corresponding French Application No. 1456610, filed Jul. 9, 2014, 2 pages.

* cited by examiner

*Primary Examiner* — Sean Gramling
*Assistant Examiner* — Gerald J Sufleta, II
(74) *Attorney, Agent, or Firm* — Christensen O'Connor Johnson Kindness PLLC

(57) ABSTRACT

Cutoff mechanism for a motor vehicle headlight, that has a bar formed by an obturation plate carried by a movable appliance configured so as to move the plate in a plane and thus obscure a light beam to a greater or lesser extent so as to change the optical operating mode, further having a mechanism for actuating the movable appliance using an electromagnet having an induction coil associated with a ferromagnetic core, wherein the electromagnet has at least one ferromagnetic core fixed with respect to its induction coil and in that the movable appliance has at least one permanent magnet configured so as to cooperate magnetically with the ferromagnetic core.

13 Claims, 4 Drawing Sheets

CUTOFF MECHANISM COMPRISING A BAR CARRYING A PERMANENT MAGNET

FIELD OF THE DISCLOSURE

Embodiments of the present disclosure generally relate to light projectors, and more particularly, to headlights for motor vehicles.

BACKGROUND

Motor vehicle headlights generally comprise a reflector in which there are arranged a light source and means for controlling the form of the beam in order to adapt the latter to the driving circumstances.

Using a cutoff bar allowing various phases of obscuring the light beam is known. The bar is actuated electrically in order to move, on command, between at least two angular positions in which it obscures the light beam to a greater or lesser extent. This makes it possible to limit the range of the headlight, for example to that of dipped headlights, referred to as the dipped position, in order not to dazzle drivers driving in the opposite direction, or to that of full-beam headlights, referred to as the full-beam position, in which there is no obscuring.

A fixed shield is generally provided between the bar and a lens of the headlight. The fixed shield intercepts the beam that passes below the cutoff bar. When the bar is situated in the full-beam position, it is positioned between the light source and the shield and does not intervene in the form of the beam. On the other hand, when the bar is in the dipped position, it intercepts part of the light beam in addition to that intercepted by the fixed shield. In this position it is important that the bar should not allow light to pass between it and the fixed shield, in order not to illuminate undesired regions and to limit the range of the beam corresponding to dipped headlights.

The devices of the prior art that control the position of the bar generally consist of an actuation motor associated with a sensor for the position of the cutoff bar or with a stop that defines the idle position of the bar. For safety reasons this idle position is associated with the dipped position in order to avoid dazzling drivers coming from the opposite direction in the case of a failure of the device actuating the bar. Return to the stop position or to the extreme position is generally provided by a spring. The drawback of this configuration is that it requires a spring with a high return torque in order to reduce the reaction time of the movement of the bar and consequently a motor of relatively large size to counter this spring.

A basic solution for magnetic attraction of the bar by a magnet has been envisioned but such a solution comes up against the risk of demagnetization of the components used since the temperature at the bar may, in the case of a halogen lamp, exceed 250°, beyond which the magnetized elements lose their magnetic property. With the appearance of new-technology lamps, this value has been reduced and the magnetic option can be reconsidered.

SUMMARY

The aim of the present disclosure is to propose a mechanism for controlling a cutoff bar that takes best advantage of the reduction in temperature associated with the use of novel lamps that have a lower calorific value, in terms of number of parts, size and/or price of the elements that constitute it.

In accordance with one embodiment of the present disclosure, a cutoff mechanism for a motor vehicle headlight is provided. The cutoff mechanism generally includes a bar formed by an obturation plate carried by a movable appliance configured so as to move said plate in a plane and thus obscure a light beam to a greater or lesser extent so as to change the optical operating mode, further comprising a mechanism for actuating said movable appliance by means of an electromagnet comprising an induction coil associated with a ferromagnetic core, wherein said electromagnet comprises at least one ferromagnetic core fixed with respect to its induction coil and in that said movable appliance comprises at least one permanent magnet configured so as to cooperate magnetically with said ferromagnetic core.

The use of magnetic attraction or repulsion, which is made possible by the appearance of lamps replacing the halogen lamps, renders the means for moving a cutoff bar more lightweight and less complex than the traditional means.

In another embodiment said permanent magnet is attracted in the direction of said ferromagnetic core in the absence of circulation of a current in said induction coil. This solution responds easily to the problem of return to an idle position corresponding to the dipped position, in the case of a failure of the control for positioning the bar.

Advantageously, said permanent magnet is pushed by said ferromagnetic core when a current circulates in the said induction coil.

In a particular embodiment said ferromagnetic core is a cylinder positioned inside said coil and the permanent magnet is a cylinder positioned in line with said core.

Advantageously, said obturation plate is in the dipped position when said magnet adheres to said ferromagnetic core.

In another embodiment the distance between said permanent magnet and said ferromagnetic core is constant during the movement of said obturation plate. This makes it possible to keep a minimum attraction force of the permanent magnet on the ferromagnetic core, after repelling thereof by the induction coil.

Advantageously, said ferromagnetic core extends in two lateral uprights leaving between them a hollow cylindrical shape in which the permanent magnet is a cylinder positioned so as to rotate freely in said hollow cylindrical shape.

In some embodiments, the two magnetic poles of said permanent magnet are substantially aligned in the direction of the lateral uprights when the induction coil is not supplied with electric current.

The two poles are however not strictly aligned in order to prevent the movable appliance going randomly in one direction or the other under the effect of an electric current in the induction coil of the electromagnet. By keeping a slight angular difference from perfect alignment, the direction of rotation of the bar is imposed when an electric control current is transmitted.

In another embodiment, said movable appliance is a spindle which is integral in rotation with said permanent magnet.

Advantageously, said spindle carries a finger configured so as to abut against at least a first stop carried by a fixed structure of said mechanism, said stop defining the position of quasi-alignment of the magnetic poles of the permanent magnet in the direction of said lateral uprights. In this way the idle position of the bar and therefore the positioning of the beam in the dipped position are defined precisely.

More advantageously, said spindle carries a finger configured so as to abut against at least a second stop carried by a fixed structure of said mechanism, said stop defining an extreme position for the movement of said obturation plate. In this way the position of the beam in the full-beam position is defined precisely.

In another embodiment said permanent magnet is pushed in the direction of said ferromagnetic core by a return spring. This solution avoids using an excessive attraction force and therefore makes it possible to choose a relatively small magnet.

In some embodiments, the force by which said magnet is repelled by said ferromagnetic core when a current circulates in said induction coil is greater than the force of said return spring.

The disclosure also relates to a headlight for a motor vehicle comprising a cutoff mechanism as described above.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The detailed description set forth below in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "right hand," "left hand," "lateral," "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations. In the following description, the references longitudinal or lateral are with reference to the optical axis of the reflector and the terms front or rear refer to the direction in which the light beam propagates.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc.

Figure 1:
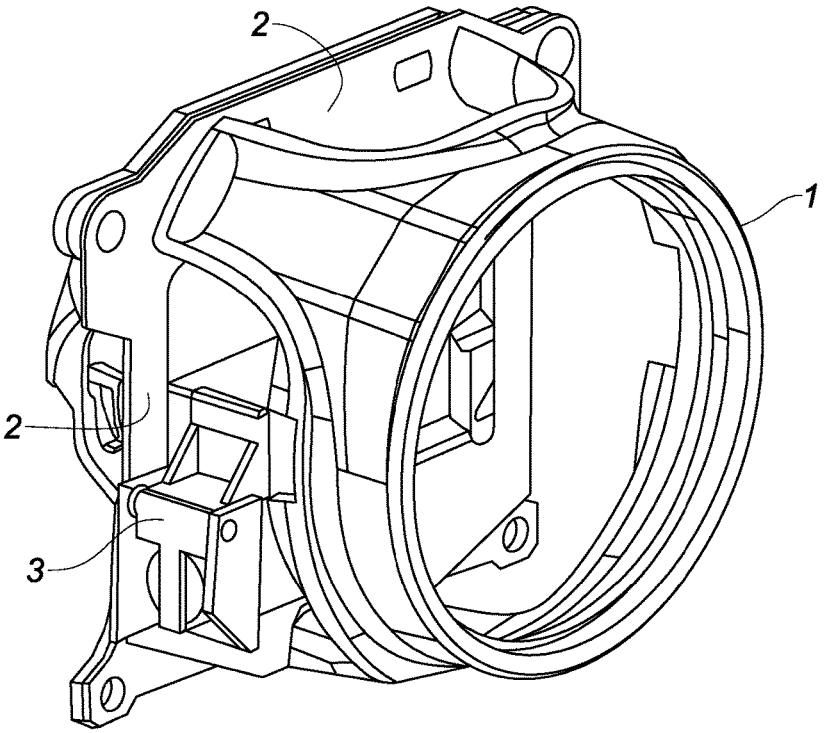
FIG. 1 is a perspective view of an element of a vehicle headlight comprising a cutoff mechanism formed in accordance with one embodiment of the present disclosure.

Referring now to FIG. 1, the front part of a motor vehicle headlight comprising a cylindrically shaped lens holder 1 that extends forwards from a rectangular shaped frame 2 can be seen. The latter lies in a plane perpendicular to the optical axis of the beam and is cut out at its center in order to allow said beam to pass. To this frame is fixed the cutoff mechanism, the function of which is to obscure the beam to a greater or lesser extent according to the conditions under which the vehicle is travelling. In a way that cannot be seen, a light source generating the beam and a reflector that orientates this beam forwards and towards the lens (not illustrated), which is installed at the front end of the lens holder 1, are arranged at the rear of this frame.

Figure 2:
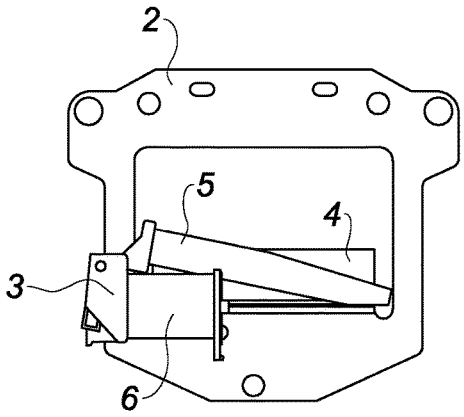
FIG. 2 is a front view of the cutoff mechanism of FIG. 1, positioned on a frame in the full-beam position.
Figure 3:
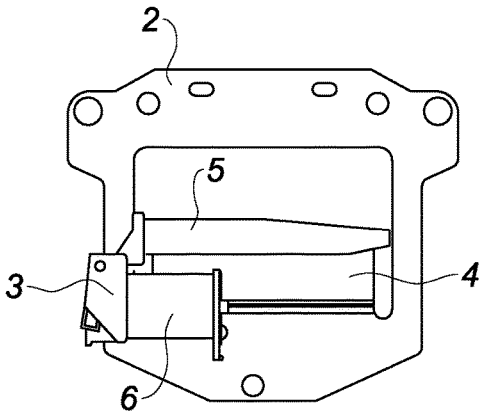
FIG. 3 is a front view of the cutoff mechanism of FIG. 1, positioned on a frame in the dipped-beam position.

Referring to FIGS. 2 and 3, the cutoff mechanism 3 that is mounted in a low position on the frame 2 can be seen in front view, respectively in the full-beam position and in the dipped-beam position. In this case, this frame comprises, at the bottom part of its central cutout, a fixed shield 4 that partly closes off this cutout and in front of which a cutoff bar 5 for modulating the form of the beam output from the headlight can move. This bar 5 is able to rotate in a plane perpendicular to the light beam and is moved by an actuating motor 6.

In FIG. 2, corresponding to the full-beam position, the bar is retracted, that is to say it is inclined downwards and reveals the fixed shield 4, which allows almost all the light beam to pass. In FIG. 3, corresponding to the dipped-beam position, the bar is raised and cuts off the beam over a greater height than the fixed shield 4 would do alone. After it is returned by the lens, the beam is then oriented downwards, which avoids dazzling the drivers of vehicles coming in the opposite direction.

Figure 4:
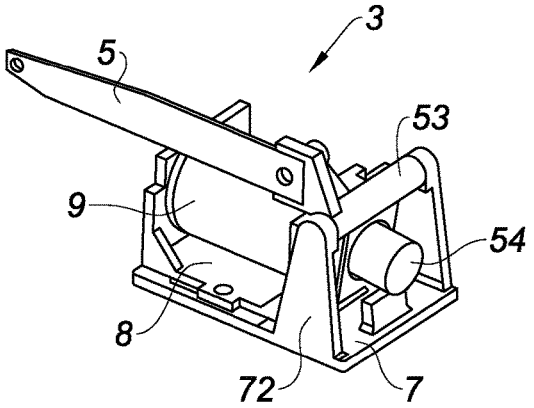
FIG. 4 is a perspective view of a cutoff mechanism formed in accordance with another embodiment of the present disclosure.
Figure 6:
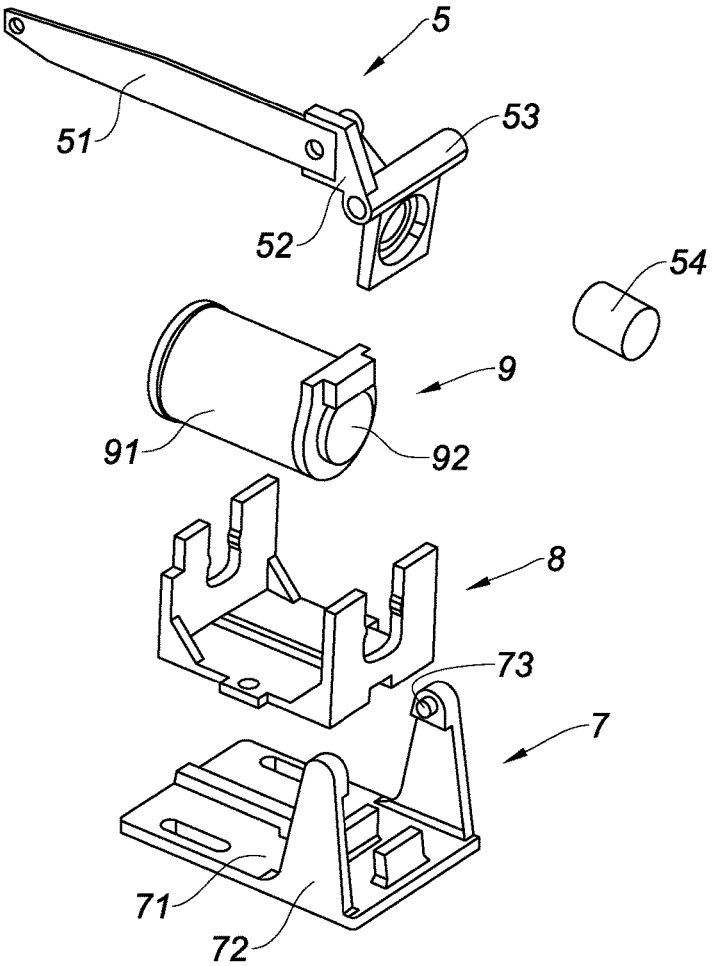
FIG. 6 is an exploded view showing, in perspective, the various elements constituting the cutoff mechanism of FIG. 4.

FIG. 4 shows the cutoff mechanism 3 in a first embodiment and is illustrated in an exploded fashion in FIG. 6. It comprises a chassis 7 intended firstly to carry all the elements of the mechanism 3 and secondly to secure this mechanism to the frame 2 of the vehicle headlight. This chassis is formed by a rectangular plate 71 from which there extend two arms 72 projecting perpendicularly from the plate in order to carry two journals 73. These journals form the support for a rotation spindle of the cutoff bar 5, as will be explained in detail below. The plate 71 is moreover pierced with slots through which means of the screw type will pass for fixing the cutoff mechanism 3 on the frame 2.

A metal casing 8 that forms a cradle for an electromagnet 9 and forms with it the actuating motor 6 is secured to the chassis 7. The casing 8 provides a magnetic loop for the electromagnet 9. It has a parallelepipedal shape, two faces of which are cut out in order to allow free access to the longitudinal ends of the electromagnet 9. The latter comprises an induction coil 91 formed by turns that are supplied with electric current in order to actuate the motor, and a ferromagnetic core 92 placed at the center of the coil 91. This core is fixed longitudinally in the coil and its function is firstly to serve as an attraction point for a force exerted by a permanent magnet when the coil is not supplied, and secondly to push this permanent magnet when the coil is supplied.

The cutoff bar 5 comprises a flat plate 51 for obscuring the beam that extends transversely over a length enabling it to obscure the beam over its entire width and wherein the form of its top edge corresponds to the form that it is wished to give to the beam in the dipped position. This obturation plate 51 is carried by a plate support 52 formed around a rotation spindle 53 that is oriented in a direction perpendicular to the obturation plate 51 so as to enable the latter to rotate in its plane. The plate support 52 comprises, extending from the rotation spindle 53, firstly means for securing the obturation plate 51 and secondly means for securing a first permanent magnet 54. This permanent magnet 54 has a cylindrical shape, the diameter of which is substantially equal to that of the ferromagnetic core 92. Moreover, the plate support 52 is formed so that the first permanent magnet 54 is substantially aligned with this core when the rotation spindle 53 is mounted on the journals 73 of the chassis 7. In this way the permanent magnet is naturally attracted by the ferromagnetic core, which is fixed, and tends to turn the obturation plate upwards in the absence of any current circulating in the induction coil 91.

Figure 5:
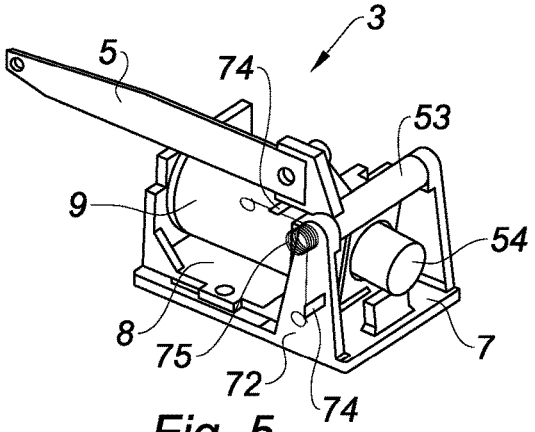
FIG. 5 shows in perspective a variant of the cutoff mechanism of FIG. 4.

FIG. 5 shows a variant of the first embodiment in which a return spring is added to assist the return of the bar to the dipped position. In fact, after a current passes in the coil, the permanent magnet 54 is pushed to a distance from the ferromagnetic core and the force of attraction of one to the other, which is proportional to the square of the distance that separates them, greatly decreases. When the current in the coil is cut off it may happen that this force in insufficient to return the permanent magnet, and consequently the cutoff bar 5, to the dipped position, or at the very least to return it sufficiently quickly. The movement of the bar may in fact be too slow to be compatible with the reaction times required for a vehicle light. The variant consists in this way of assisting this return by introducing a return spring 75 that is positioned on one of the extension arms 72 of the chassis 7 and complements the magnetic attraction force. In the configuration depicted, this spring is a spiral spring that acts in separation and which, for this purpose, is supported on two lugs 74 positioned respectively on the extension arm 72 that carries the spring and on the obturation plate 51 of the bar.

Figure 7:
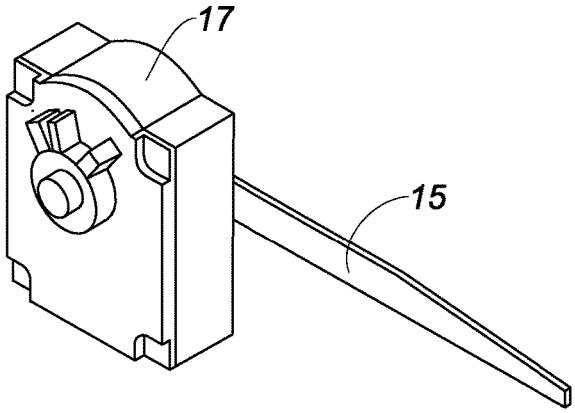
FIG. 7 is a perspective view of a cutoff mechanism formed in accordance with another embodiment of the present disclosure, showing an assembled version.
Figure 8:
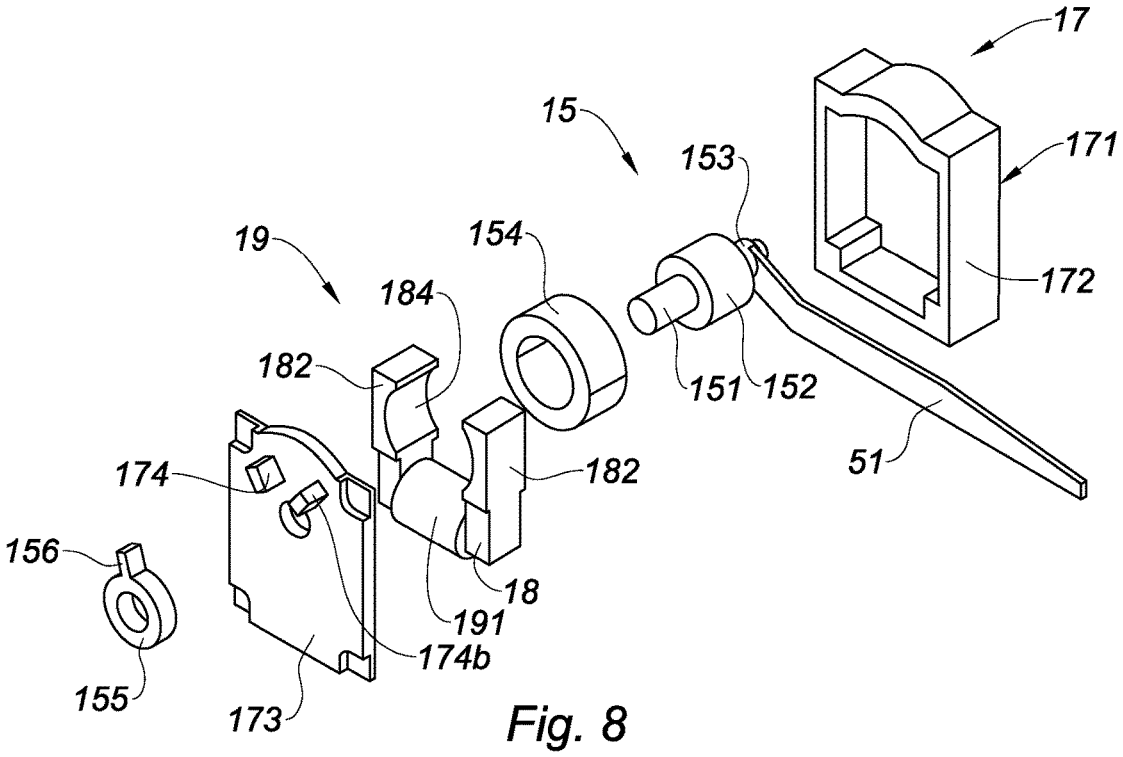
FIG. 8 is an exploded view showing, in perspective, the various elements constituting the cutoff mechanism of FIG. 7.
Figure 9:
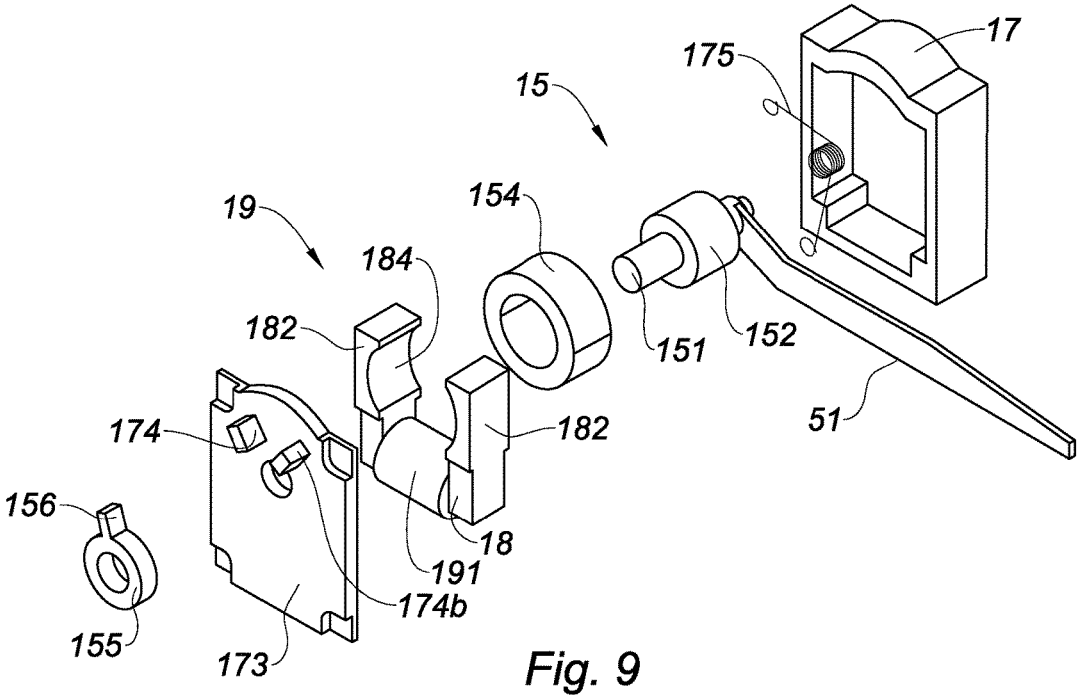
FIG. 9 shows, in exploded perspective, a variant of the cutoff mechanism of FIG. 4.

Referring to FIGS. 7 to 9, a second embodiment will now be described. The elements of this embodiment that are identical to the first embodiment are designated by the same reference numbers and are not described afresh.

FIG. 7 shows the cutoff mechanism 3 in the assembled version, in the form of a parallelepipedal housing from which the obturation plate 51 of the bar 15 extends laterally and in which an electromagnet 19 is arranged.

Referring to FIG. 8, the housing 17 comprising a bottom 171 and lateral walls 172 can be seen, the whole being closed by a cover 173 that is positioned on the face opposite to the bottom. The bottom 171 and the cover 172 both comprise a hole forming a support for a rotation spindle 151 carrying the bar 15.

The rotation spindle 151 of the bar has a cylindrical form of revolution and extends inside the housing 17 until it passes both through the bottom 171 and the cover 172. It has a diameter that corresponds to that of the holes that are formed in these two walls. It has moreover between its two ends a cylindrical form with a greater diameter 152 in order to adapt to the inside diameter of a second cylindrical permanent magnet 154, as will be explained below. At one of the ends of this thickened cylinder 152 there is a means 153 for attaching the obturation plate 51 that makes it possible to drive the latter by actuating the rotation spindle 151.

The second cylindrical permanent magnet 154, which, with an induction coil 191 and a metal casing 18, forms the electromagnet 19, has a hollow cylindrical shape, the inside diameter of which is equal to the outside diameter of the thickened cylinder 152 of the bar 15. In this way the thickened cylinder 152 is forcibly inserted in the second permanent magnet 154 and is rendered integral in rotation with it. Any rotation of the permanent magnet causes a rotation of the rotation spindle 151 and a circular movement of the obturation plate 51. The outside diameter of the second permanent magnet 154 is such that it can be inserted, without contact, inside the metal casing 18, which, with the induction coil 191, provides the rotation of this second permanent magnet 154 and ultimately of the bar 15.

The metal casing 18 is produced from a ferromagnetic material and has a U shape comprising a lower branch on which the induction coil 191 is wound, as in the first embodiment, and two lateral uprights 182 parallel to the lateral walls 172 of the housing 17. The upper part of these lateral uprights, which face each other, is here hollowed out so as to form between them a hollow cylindrical shape 184, oriented longitudinally. This hollow cylindrical shape 184 has a diameter slightly greater than the outside diameter of the second permanent magnet 154 so that the latter can rotate freely inside this hollow cylindrical shape, under the action of a current passing through the induction coil 191. Because of the cylindrical shape of the magnet and of the casing, the air gap between them remains constant during the rotation of the permanent magnet.

The second permanent magnet 154 has two magnetic poles that are situated on both sides of its axis of revolution, so that, in the absence of any current in the coil, they each come to be placed opposite one of the lateral uprights 182 at the center of their hollow cylindrical shape 184. And, in this position, the bar 15 is in the dipped position.

When a current is sent into the turns of the induction coil 191, the magnetic field created between the two lateral uprights 182 pushes the magnetic poles of the polar magnet 154 and causes a rotation of the second permanent magnet 154. This rotation causes a circular movement of the bar 15, which is positioned in the full-beam position.

In order to precisely define the dipped- and full-beam positions, two rotation stops 174 and 174*b* with a parallelepipedal shape extend longitudinally from the cover 173. One face for each of them is aligned with the center of the hole forming a support for the rotation spindle 151. Moreover, the rotation spindle 151 carries at its end that passes through the cover 173 a stop cylinder 155 that fits on the rotation spindle and from which there extends radially a stop finger 156, also parallelepipedal in shape. The stop cylinder comprises at its center a hollow cylindrical shape, the diameter of which is substantially equal to that of the rotation spindle 151, in its non-thickened portion, so that it can be force-fitted on this rotation spindle. As for the stop finger 156, this extends radially so as to be able to come into contact with the faces of the stops 174 and 174*b* that are aligned with the center of the support hole of the rotation spindle. The stop finger 156 can thus move between two extreme positions, defined by the stops 174 and 174*b*. In a first position that corresponds to the dipped position, the stop finger abuts on a first stop 174 because of an absence of current in the induction coil and consequently an attraction of the poles of the second permanent magnet 154 by the ferromagnetic metal of the lateral uprights 182. In a second position, which corresponds to the full-beam position, the stop finger abuts against the second stop 174*b* because of the electromagnetic forces generated between the lateral uprights of the casing 18 by the passage of a current in the induction coil.

It should be noted that, in the idle position, the axis connecting the poles of the second permanent magnet 154 is not strictly aligned with the transverse direction of the hollow shape 184 so that, when a current is transmitted into the coil 191, the action of the electromagnetic forces always causes a rotation of the spindle 15 in the direction of the full-beam position. A perfect alignment of this axis would in fact have corresponded to an unstable position when a current is applied to the induction coil and from which the bar 15 would be liable to rotate, randomly in one direction or the other.

FIG. 9 shows a variant of the second embodiment that forms the counterpart of the variant of the first embodiment, with the presence of a return spring 175 forcibly mounted on the rotation spindle 151. This return spring is positioned on the end of the rotation spindle in its non-thickened part, which faces the bottom of the housing 17. As before this spring is a spiral spring that acts in separation and which, for this reason, is supported on two lugs (not shown) positioned respectively on the bottom of the housing 17 and on the obturation plate 51 of the bar. The purpose of this return spring, as in the first embodiment, is to facilitate the return to the dipped position and to increase the speed of movement of the bar towards this position when the current in the coil is cut off.

The functioning of the cutoff mechanism according to the first or second embodiment, in the nominal version, will now be described. The functioning in the variant is similar, except that the spring improves the return to the dipped position.

In the absence of a current passing through the induction coil 91 or 191, the ferromagnetic core 92 or 182 thereof undergoes an attraction on the part of the permanent magnet 54 or 154. As this core is fixed, it is the magnet that moves. In the first embodiment the first permanent magnet 54 adheres to this core, thus rotating the plate support 52 and, in the second embodiment, the second permanent magnet 154 rotates on itself in order to align its poles with the ferromagnetic lateral uprights 182. In the two embodiments the movement or rotation of the permanent magnet causes a rotation of the element that supports the obturation plate 51 (plate support 52 or rotation spindle 151) and brings the bar into a position where it is in abutment. This abutment is formed by the contact of the first magnet 54 with the ferromagnetic core in the first embodiment and by the contact of the stop finger 156 against a stop 174 on the cover in the second embodiment. The contact on a stop ensures a precise positioning of the obturation plate and therefore the height of the beam in the dipped position. Moreover, the fact that this position is obtained in the absence of any current in the coil makes it an idle position in which the obturation plate is positioned in the case of failure and therefore constitutes the automatic passage to dipped position in this case.

The actuation of the obturation plate takes place in the two embodiments by transmitting a current into the induction coil 91 or 191 that creates a pole with the same sign facing the pole of the permanent magnet that faces the ferromagnetic core 92 or the lateral uprights 182. This generates a repelling of the first permanent magnet 54 in the first embodiment or a rotation of the second permanent magnet 154 in the second embodiment, and therefore a rotation of the bar and of its obturation plate 51, which then moves away from the light beam.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The invention claimed is:

1. A cutoff mechanism for a motor vehicle headlight, comprising:

a bar formed by an obturation plate carried by a movable appliance configured so as to move said obturation plate in a plane and thus selectively obscure at least a portion of a light beam so as to change an optical operating mode; and a mechanism configured for actuating said movable appliance via an electromagnet comprising an induction coil associated with a ferromagnetic core, wherein said electromagnet comprises said ferromagnetic core that is fixed with respect to said induction coil and said movable appliance comprises at least one permanent magnet configured so as to cooperate magnetically with said ferromagnetic core, said permanent magnet being attracted in a direction of said ferromagnetic core in the absence of circulation of a current in said induction coil.

2. The cutoff mechanism of claim 1, wherein said permanent magnet is pushed by said ferromagnetic core when a current circulates in said induction coil.

3. The cutoff mechanism of claim 1, wherein said ferromagnetic core is a cylinder positioned inside said coil and in which the permanent magnet is a cylinder positioned in line with said ferromagnetic core.

4. The cutoff mechanism of claim 3, wherein said obturation plate is in a dipped position when said permanent magnet adheres to said ferromagnetic core.

5. The cutoff mechanism of claim 1, wherein the distance between said permanent magnet and said ferromagnetic core is constant during the movement of said obturation plate.

6. The cutoff mechanism of claim 5, wherein said ferromagnetic core extends along two lateral uprights leaving between them a hollow cylindrical shape and in which the permanent magnet is a cylinder positioned so as to be free to rotate in said hollow cylindrical shape.

7. The cutoff mechanism of claim 6, wherein the two magnetic poles of said permanent magnet are substantially aligned in the direction of the lateral uprights when the induction coil is not supplied with electric current.

8. The cutoff mechanism of claim 6, wherein said movable appliance is a spindle which is integral in rotation with said permanent magnet.

9. The cutoff mechanism of claim 8, wherein said spindle carries a finger configured so as to abut against at least a first stop carried by a fixed structure of said mechanism, said stop defining the position of quasi-alignment of the magnetic poles of the permanent magnet in the direction of said lateral uprights.

10. The cutoff mechanism of claim 8, wherein said spindle carries a finger configured so as to abut against at least a second stop carried by a fixed structure of said mechanism, said stop defining an extreme position for the movement of said obturation plate.

11. The cutoff mechanism of claim 1, wherein said permanent magnet is pushed in a direction of said ferromagnetic core by a return spring.

12. The cutoff mechanism of claim 11, wherein a force by which said magnet is repelled by said ferromagnetic core when a current circulates in said induction coil is greater than a force of said return spring.

13. A headlight for a motor vehicle, comprising a cutoff mechanism according to claim 1.

* * * * *